United States Patent [19]

Daily

[11] 4,207,686

[45] Jun. 17, 1980

[54] AIR HEATER ARRANGEMENT FOR A CLOTHES DRYER

[75] Inventor: Thomas E. Daily, Herrin, Ill.

[73] Assignee: Fedders Corporation, Edison, N.J.

[21] Appl. No.: 861,644

[22] Filed: Dec. 19, 1977

[51] Int. Cl.[2] ..... F26B 11/04

[52] U.S. Cl. ..... 34/133; 34/242

[58] Field of Search ..... 34/131, 132, 133, 242

[56] References Cited

U.S. PATENT DOCUMENTS

| | | | |
|---|---|---|---|
| 2,940,179 | 6/1960 | Czech | 34/133 |
| 3,333,346 | 8/1967 | Brucken | 34/131 |
| 3,504,444 | 4/1970 | Nelson et al. | 34/131 |
| 3,523,373 | 8/1970 | Fueissner | 34/133 |
| 3,616,547 | 11/1971 | Schuurink | 34/133 |
| 3,750,304 | 8/1973 | Ghadiali | 34/131 X |
| 3,858,330 | 1/1975 | De Pas | 34/131 X |

*Primary Examiner*—Larry I. Schwartz

*Attorney, Agent, or Firm*—Bacon & Thomas

[57] ABSTRACT

A heater for a clothes dryer has a centrally mounted fan operable to drive air radially outwardly, and a radially mounted heater disposed circumferentially about the fan and downstream thereof. The heater is supported on a series of insulated retainer devices which include a radiation baffle operable to prevent lint from building up in the vicinity of the heating element and spacer portions operable to serve as a positioning stop for the rear seal of the heater.

5 Claims, 5 Drawing Figures

AIR HEATER ARRANGEMENT FOR A CLOTHES DRYER

BACKGROUND OF THE INVENTION

This invention relates to an air heater arrangement for a clothes dryer which is an improvement over the type of arrangement disclosed in U.S. Pat. No 3,504,444. Heaters suitable for supplying a stream of heated air for use in such appliances are well known. They are usually composed of a blower of either the propeller fan or the squirrel cage type operating in conjunction with a heating element.

The heating element is mounted either upstream or downstream of the blower.

When a centrifugal squirrel cage type fan is utilized the heating element is usually mounted downstream of the exit from the blower in a duct adjacent to the blower. This type of arrangement is so well known that it is normally only diagrammatically shown in patents dealing with clothes dryers or other similar appliances. This can be seen, for example, in U.S. Pat. No. 2,498,478 to Balph; U.S. Pat. No. 2,863,224 to Zehrbach; U.S. Pat. No. 2,817,501 to Schubert; U.S. Pat. No. 2,815,416 to Kumler; and U.S. Pat. No. 2,654,961 to Manecke.

When a propeller fan type blower is utilized, the heating element is normally mounted in a duct located either upstream or downstream of the blower. When mounted downstream of the blower, the heating element usually takes the form of an array of electrical resistance wires disposed across the opening in the duct. This type of arrangement is shown, for example, in U.S. Pat. No. 2,942,353 to Barnett; U.S. Pat. No. 1,755,539 to Gerosa; U.S. Pat. No. 2,328,256 to Breckenbridge; U.S. Pat. No. 2,026,189 to Purkett; U.S. Pat. No. 2,617,203 to Murray; U.S. Pat. No. 2,708,230 to Bowman; and U.S. Pat. No. 2,679,112 to Thompson, which show a propeller type fan directing air directly over an electrical element, which element is mounted substantially in the same chamber as the fan.

An upstream heater configuration utilizing a propeller fan is shown in U.S. Pat. No. 2,587,646 to O'Neil, wherein an annular heating element is shown mounted upstream of a propeller type blower. Air is caused to be drawn over the heating elements as a result of the placement of a baffle behind the fan blade. Thereafter, the air passes over the propeller blade and is forced into the drying chamber through a perforated wall.

A disadvantage which occurs to a greater or lesser extent in the prior art heater arrangements discussed above is that air flow is diffused when it flows over the heating element. That is, with a downstream mounted heating element, the air leaving the blower travels to, and is spread across, the area of the full opening of the outlet of the blower or the duct in which the heating element is mounted. Thus the heating element "sees" a somewhat spread out air flow. Similarly, the air drawn over an upstream mounted heating element is somewhat diffused in terms of flow rate.

Because the velocity and volume of air flowing directly over the heating elements are somewhat diffused, as discussed above, it has been necessary to utilize higher gauge and therefore more expensive resistance elements, that is elements capable of withstanding higher temperatures than would be necessary for the same heat dissipation rate (and blower) if a less diffuse air flow were produced over the heating elements.

A second disadvantage of most prior art arrangements is the use of a separate structure for holding the heating element from that in which the fan operates. This requires additional cost factors in the manufacture of the appliance.

BRIEF DESCRIPTION OF THE INVENTION

The present invention utilizes the maximum air flow concentration, which occurs as the air leaves the fan impeller, to permit the utilization of smaller gauge heater resistance elements than would otherwise be required for heating the air without increasing the blower capacity. Additionally, the heating element and the fan are contained in one housing to reduce costs and increase efficiency of operation. Finally, the heater retainer device for supporting the heater in the housing with the fan includes a seal stop portion to further reduce costs of assembly.

A circular electrical resistance heating element is disposed circumferentially about a propeller type fan such as is described in U.S. Pat. No. 3,504,444. The fan, in combination with the heater mounting element and housing, is designed to force substantially all the driven air radially outwardly and directly against the circumferentially mounted heating element without accumulating an objectionable high lint build-up. Thus the maximum air velocity and flow of air across the heating element is obtained by substantially constraining the air to flow in a radial direction and by mounting the heating element circumferentially about the propellor type fan immediately downstream and in the path of the air.

Tab portions formed on the heater element retaining device pass through the housing and act to prevent a fabric-heater seal supported on the housing from slipping; while the design and placement of the heater element retaining device restrains the build up of lint to an extent sufficient to avoid fire hazard in the dryer.

DESCRIPTION OF THE PREFERRED EMBODIMENT

Figure 1:
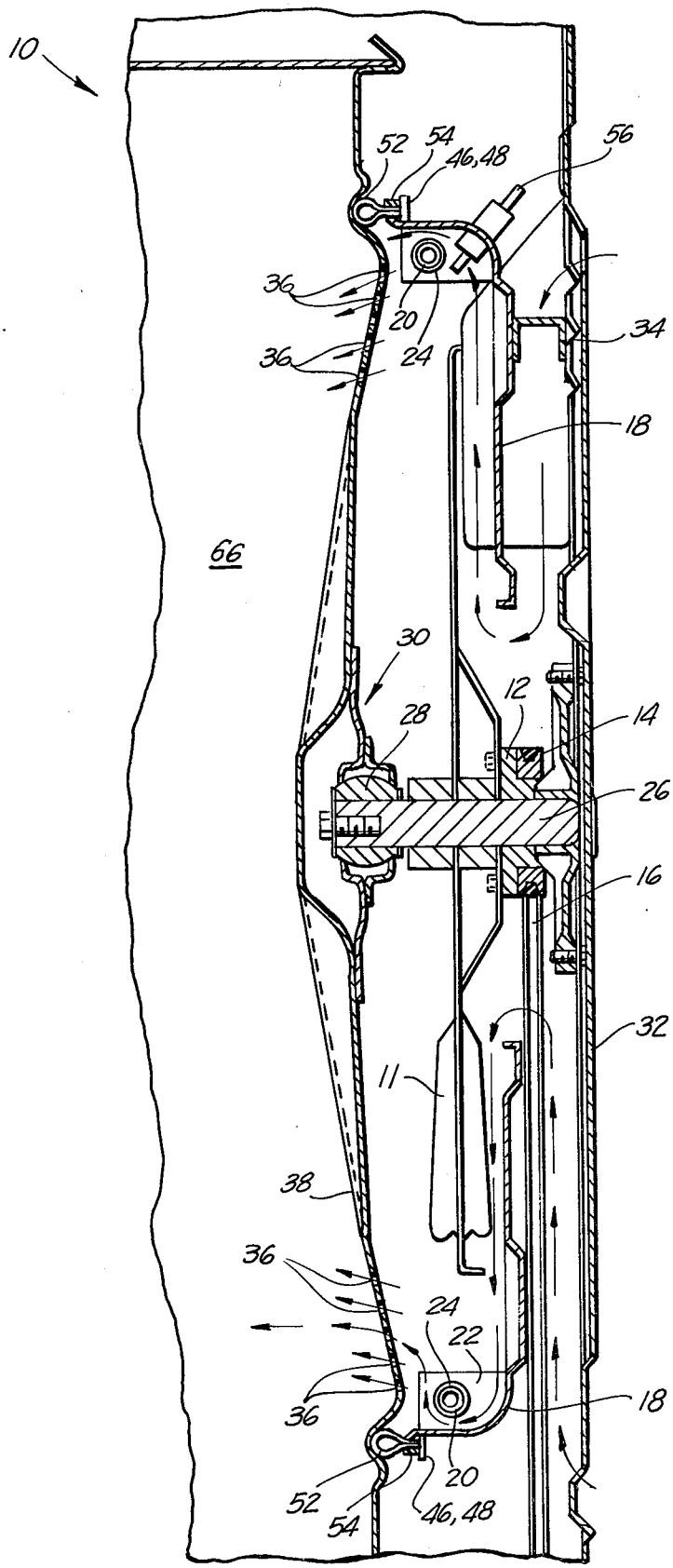
FIG. 1 is a vertical sectional view of the rear portion of a clothes dryer showing the air circulation and heating arrangement of the present invention.

Referring now to FIG. 1, the air circulation and heater means of a domestic clothes dryer 10 includes a propeller fan 11 mounted on a hub 12 driven by pulley 14 which is driven by belt 16. Belt 16 is driven by a motor (not shown) in any usual manner.

Figure 4:
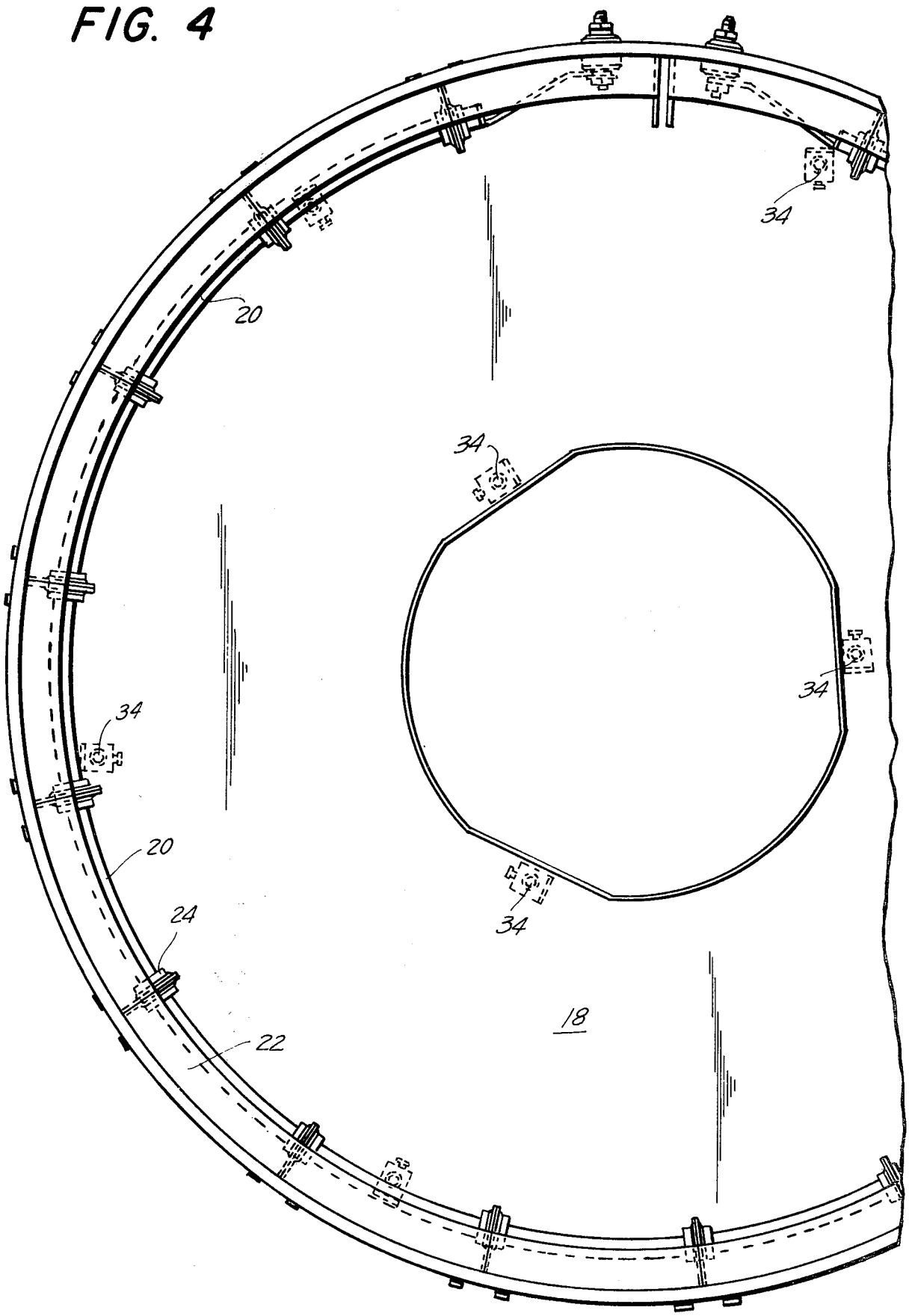
FIG. 4 is a plan view of an assembled housing according to FIG. 3.

The propeller 11 is constrained to rotate within a housing 18. Circumferentially disposed about the propeller 11 and within the pan housing 18 is a heater element 20 (see also FIG. 4). The heater element 20 is supported in the housing 18 by heater retaining devices 22 which, as will be described in detail below, support an insulating member 24. These elements 22, 24 are shown in detail in FIGS. 2*a* and 2*b*.

As is usual in domestic clothes dryers, a basket or drum 66 is mounted for rotation about a substantially non-vertical axis which axis, in the present case, is co-extensive with the shaft 26 about which the propeller hub 12 is also mounted.

As shown in FIG. 1, the end of the shaft 26 supports a ball-like bearing 28 which in turn supports a ball socket 30 formed or attached to the drum 66. The shaft 26 is mounted on the rear wall 32 of the dryer in a usual manner, as shown in FIG. 1. Brackets 34 are provided to secure the pan housing 18 to the rear wall 32 in spaced apart relation thereto. This structure 18, 32, 34, defines passages A through which air may be drawn by propeller 11, as shown in FIG. 1 and as is set forth in detail in U.S. Pat. No. 3,504,444, incorporated herein by reference. Air flow, as generally shown by the arrows in FIG. 1, is through the passage A and through the fan 11 which drives the air radially outwardly and directly against the heater element 20. The heated air thereafter passes through orifices 36 formed in the rear wall 38 of the clothes drum 66.

Figure 2A:
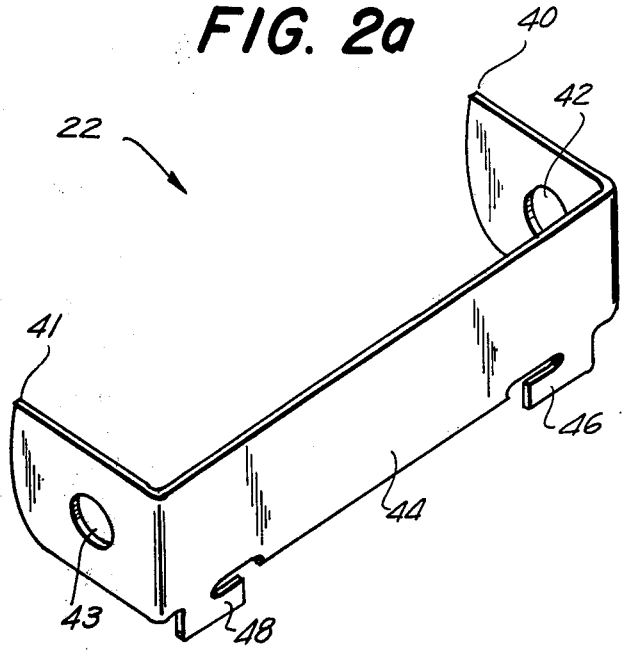
FIG. 2*a* shows a heater retainer device according to the present invention.
Figure 2B:
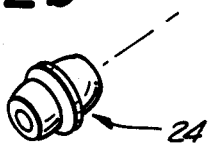
FIG. 2*b* shows an insulating member to be supported in the heater retainer device of FIG. 2*a;*

With reference to FIG. 2*a*, the heater retainer device 22 is in the form of a bracket having flanges 40, 41 with sockets 42, 43 for receiving insulating member 24, and a rear portion 44 with tab portions 46, 48 formed thereon.

Figure 3:
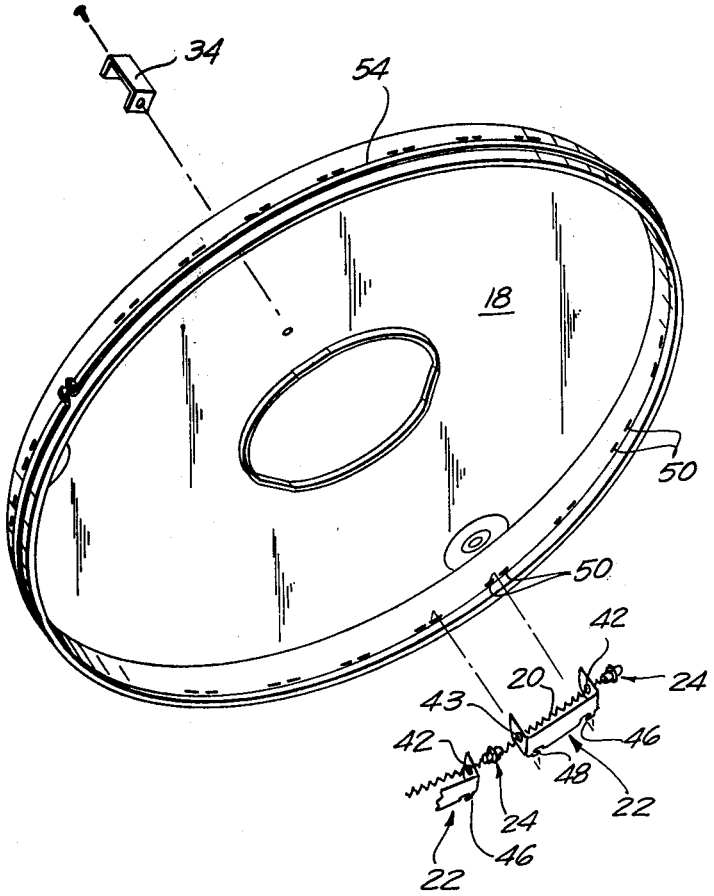
FIG. 3 is an exploded perspective view of a housing arrangement supporting a heater element.

With reference to FIG. 3, the pan housing 18, has paired slots 50 formed therein to receive tab portions 46, 48 from adjacently mounted heater retaining devices 22. As can be seen in FIG. 3, insulating members 24 are supported in a recurring arrangement, by and between adjacent heater retaining devices 22 in socket 42 of one device 22 and socket 43 of the adjacent device 22.

With reference to FIG. 1, a seal 52, preferably of synthetic fabric material suitable for the purpose, is provided circumferentially about the edge of the pan housing 18 and held thereon by a strap 54 of steel or other suitable material. As the seal 52 will otherwise be pressed downwardly onto the housing 18, the tabs 46,48 of the heater retaining device 22 are designed (see FIGS. 1 and 3) to extend through the slots 50 as a positioning stop.

The heater retainer device 22 is therefore both a means to secure the heater element 20 in the housing, and positioning stop for the seal 52, providing a more convenient and less expensive assembly for a clothes dryer heater. Additionally, the interaction between the air flow and the heater retaining device 22 especially at flanges 40, 41 is such as to restrain sufficient lint build-up to cause a fire hazard. Any lint build-up is limited by the size of the flanges 40, 41.

A thermostat control 56 for the heater element 20 may be provided in the path of air flow, as is usual.

The combination of elements and their disposition with respect to each other to form an air heater arrangement for a clothes dryer, as discussed herein, can be employed to produce a domestic clothes dryer which combines efficiency of operation of the heater, with a structure which has favorable cost consideration. However, although the embodiment disclosed herein is a presently preferred embodiment, it will be obvious to those skilled in the art that various modifications and changes may be made without departing from the invention, and it is therefore aimed, in the appended claims, to cover all such equivalent variations as fall within the true spirit and scope of the invention.

What is claimed is:

1. In an air heater arrangement for a clothes dryer, said arrangement including a fan for driving air radially outwardly, a heater element for heating said air, and a drum, the improvement comprising:

a. a pan housing at the rear of said drum, said pan housing being mounted vertically and circumferentially enclosing said fan within said pan housing;

b. said fan mounted within said pan housing between said housing and said drum; and, c. said heater element being mounted radially outwardly and substantially circumferentially surrounding said fan and within said pan housing; whereby air directed radially outwardly by said fan is directed over said heater element and into the rear of said drum.

2. The air heater arrangement of claim 1, further including:

a plurality of heater element retaining devices, said heater element retaining devices being operable to support and retain said heater element in said pan housing.

3. The arrangement of claim 2 wherein said pan housing further includes a fabric seal disposed about its edges, said heater element retaining devices being operable to act as a positioning stop for said seal.

4. The arrangement of claim 3 wherein said heater element retaining devices include means to restrain the accumulation of lint in the vicinity of said heater element.

5. In an air heater arrangement for a clothes dryer, said arrangement including a fan, a heater element, and a drum, the improvement comprising:

a. a pan housing at the rear of said drum, said pan housing being mounted vertically, and including a fabric seal disposed about the edge of said pan housing;

b. said fan mounted within said pan housing between said housing and said drum; and, c. said heater element being mounted radially outwardly of said fan and within said pan housing, and heater element retaining devices operable to act as a positioning stop for said seal; whereby air directed radially outwardly by said fan is directed over said heater element and into the rear of said drum.

* * * * *